US006502259B2

(12) United States Patent
Chang

(10) Patent No.: US 6,502,259 B2
(45) Date of Patent: Jan. 7, 2003

(54) AIR CUSHION BED WITH FLUSHING DEVICE

(76) Inventor: Chi-An Chang, No. 1017, Jen Ai Village, Jen Te Country, Tainan County (TW)

( * ) Notice: Subject to any disclaimer, the term of this patent is extended or adjusted under 35 U.S.C. 154(b) by 0 days.

(21) Appl. No.: 09/987,285

(22) Filed: Nov. 14, 2001

(65) Prior Publication Data

US 2002/0124314 A1 Sep. 12, 2002

(30) Foreign Application Priority Data

Mar. 7, 2001 (TW) ..... 90203396 U

(51) Int. Cl.[7] ..... A61G 7/02

(52) U.S. Cl. ..... 5/606; 5/604; 5/605; 5/690; 5/715; 5/928

(58) Field of Search ..... 5/604, 605, 606, 5/695, 713, 715, 900, 928

(56) References Cited

U.S. PATENT DOCUMENTS 4,989,280 A * 2/1991 Bair ..... 4/450
5,077,845 A * 1/1992 Tokunaga et al. ..... 4/237
5,138,729 A * 8/1992 Ferrand ..... 5/604
5,588,167 A * 12/1996 Pahno et al. ..... 4/480
5,594,962 A * 1/1997 Bogdanoff ..... 5/422
5,729,848 A * 3/1998 Yamagishi ..... 4/547
5,842,237 A * 12/1998 Hargest et al. ..... 4/446

* cited by examiner

*Primary Examiner*—Michael F. Trettel
(74) *Attorney, Agent, or Firm*—Bacon & Thomas, PLLC

(57) ABSTRACT

A cushion bed with a flushing device. The bed includes a containing cushion that is adhered to the upper part of the air cushion and shaped as a tilted groove, being removable, and including a sensor. When discharge from a patient falls on the surface of the containing cushion, a sensor senses this and a water pump is activated, so that water can be spurted through both the water-spurting head to flush the discharge on the surface of the containing cushion, and the other water-spurting head installed on top of the containing cushion cleanses the excretory organs of the patient. The inventive device provides the patients in the persistent vegetative state with the convenience of urinating and defecating in bed, and with the functions of keeping the excretory organs of the patient clean and not prone to bacteria growth or infection, and sanitizes the bed cushion.

20 Claims, 4 Drawing Sheets

AIR CUSHION BED WITH FLUSHING DEVICE

BACKGROUND OF THE INVENTION

1. Field of the Invention

The present invention relates to a folding air cushion bed with a flushing device, whereby the patient in the folding air cushion bed is provided with the function of cleansing the excretory organs after urination and defecation, thus keeping the excretory organs of the patient under constant sanitary condition without being prone to bacteria-growing or an infectious state. In addition, the function of flushing excrement is provided to flush excrement down to the water outlet through a tilted base plate of the water tank, thus keeping the air cushion dry and clean, preventing the body of the patient from damping, bacteria-growing and infectious conditions, and fulfilling the effect of wastewater processing of excrement of the patient.

2. Description of the Related Art

For prior arts in sickbed design, aside from the consideration of the comfortability of the patient, certain additional functions, like beds with air cushions, are added to accommodate the need of the disabled or patients in the persistent vegetative state. However, no prior arts in sickbed design take into account the need of flushing and draining excrement of the patient and cleansing the excretory organs of the patient. The air cushion bed of the prior art comprises multiple air bladders, an air conduit and a control valve, with the air conduit connecting the multiple air bladders and jointing the control valve. Therefore the user, by operating the control valve to control the airflow, can adjust the air pressure of the air bladders, and enable the air cushion bed to be in a state of undulation for comfortable use by the patient.

Nevertheless, the air cushion bed of the prior art provides only the function of adjusting the air pressure of the air cushion for comfortable use, without considering the need of flushing excrement after urination and defecation by the disabled and patients with persistent vegetative state, and cleansing the excretory organs of the patients. Besides, even though the caregivers can use wet towels to clean the patients, the sanitary effect will not be thorough, for the caregivers cannot provide the patients with body-bathing and hair-washing needs. Even though the caregivers may try to bathe the patients with water, the wastewater will wet the sheets and drip to the ground, thus creating a dangerous working environment for the caregivers as well as inconvenience for the patients.

The primary object is to provide an air cushion bed with the function of flushing excrement and cleansing the body of the disabled or patients in the persistent vegetative state; in addition, with the design of a containing and draining device, wastewater is not to be spilled, thus improving on the inconvenience caused by those designs disclosed in prior arts regarding the care-giving of patients.

SUMMARY OF THE INVENTION

The present invention provides an air cushion bed with flushing device, whereby the functions of sickbeds are upgraded by combining air cushion beds with flushing and water-draining device, thus furnishing a hygienic environment for patients. The present invention includes a cushion with at least one air bladder, a water tank, a removable containing cushion, a sensor, a water valve and a controller.

The water tank contains front, rear, left and right walls and a tilted base plate with a water outlet, and is supported by a supporting frame. The containing cushion, shaped as a shallow bowl, is tiltedly adhered in between two air bladders of the air cushion under the buttocks of the patient, so when the patient's excrement falls on the surface of the containing cushion, the sensor then senses and transmit the signal to the controller, which activates the water valve to spurt water (cool in summer and warm in winter) through both the water-spurting head on top of the air cushion towards the patient's excretory organs for cleansing purpose, and the other water-spurting head to flush excrement down to the water tank and discharge through a water outlet. Therefore, the present invention provides the disabled and patients in the persistent vegetative state with the convenience of urinating and defecating in bed, as well as a solution of processing excrement and discharging wastewater.

Another object of the present invention is to rid the need for the disabled or patients in the persistent vegetative state of using adult diapers, thus alleviating the financial burden of the patient's family by saving the expenses of using adult diapers; in addition, with the need to wear adult diapers gone, the patient's body can be kept from dampening and germ-growing condition without any skin affection.

BRIEF DESCRIPTION OF THE DRAWINGS

These and other features, aspects and advantages of the present invention will become better understood with regard to the following description, appended claims and accompanying drawings where:

DETAILED DESCRIPTION OF THE PREFERRED EMBODIMENTS

Figure 1:
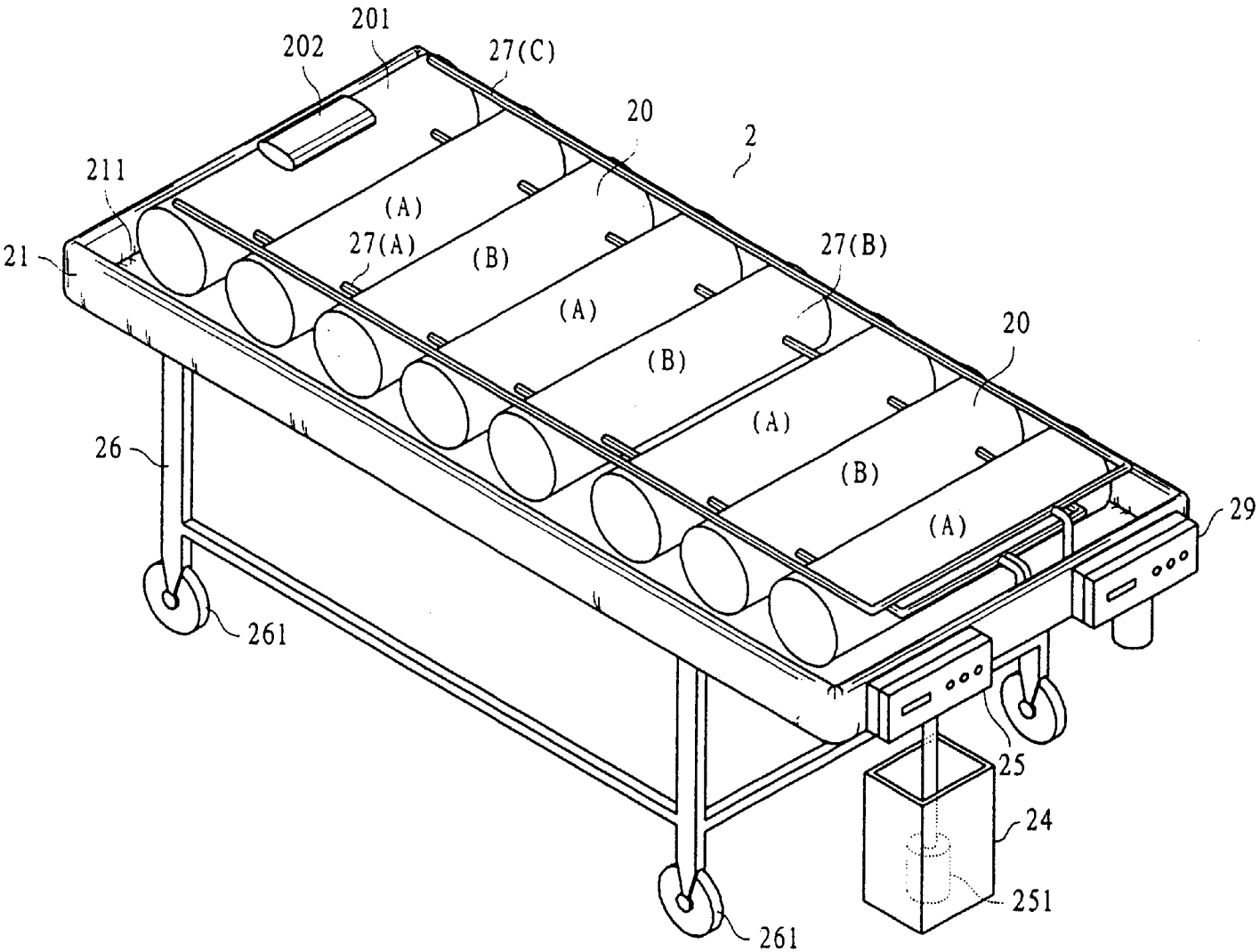
FIG. 1 is a structural schematic view of an air cushion bed of the present invention.
Figure 2:
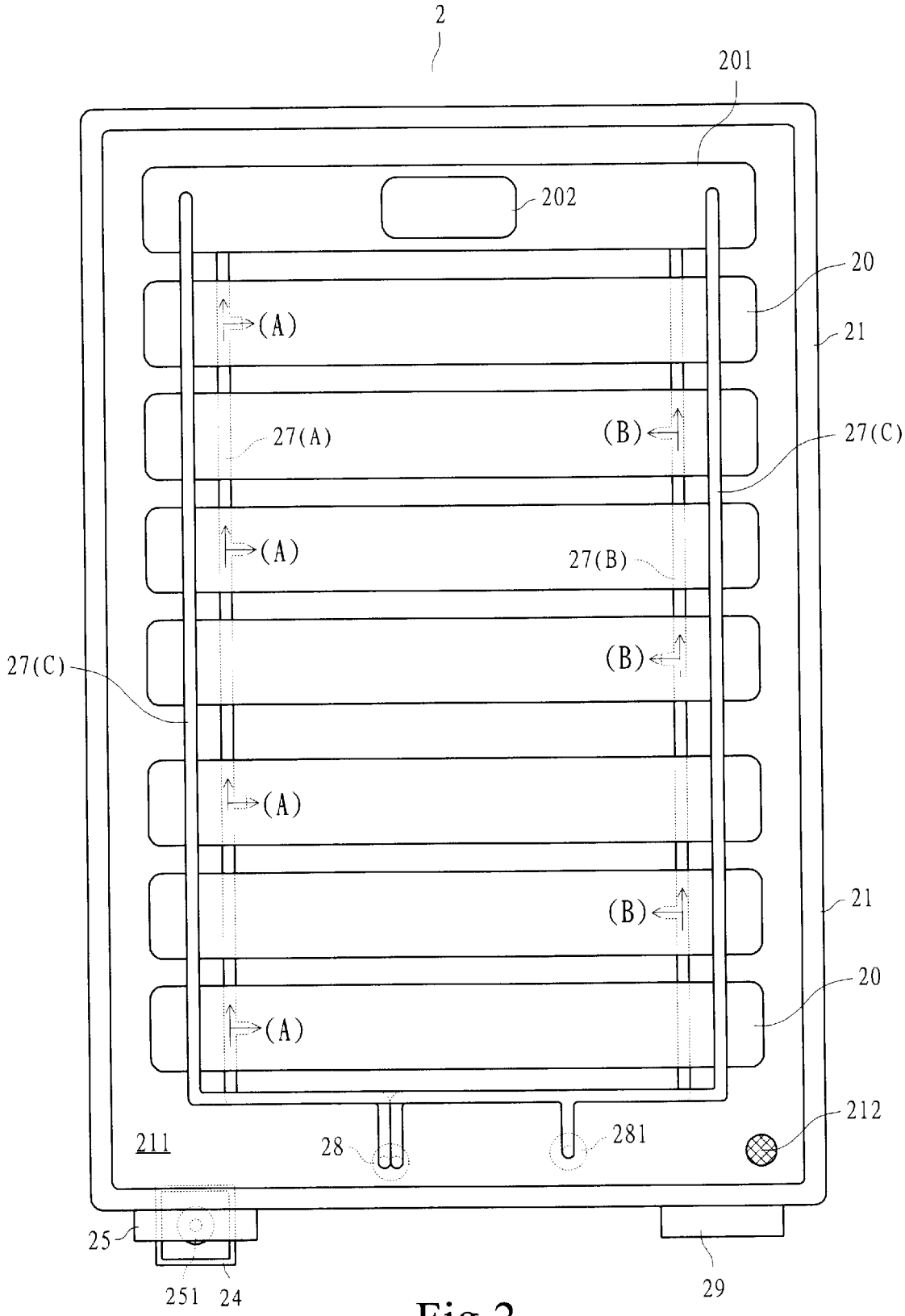
FIG. 2 is a top plan view of an air cushion bed of the present invention.

FIG. 1 and FIG. 2 show respectively a structural schematic view and a top plan view of an air cushion bed 2 of the present invention, which comprises at least one air bladder 20 made of waterproof material, a water tank 21, a containing cushion 22 made of waterproof material (shown in FIG. 4 and FIG. 5), water-spurting heads 30, a sensor (not shown in drawings), a water container 24 and the first controller 25; wherein the air cushion is laid on top of the base plate of the water tank, and the containing cushion 22, tiltedly adhered on top of the air bladder 20, is shaped as a groove that depresses in the middle and heightens at both the front and rear ends. When the patient urinates or defecates, the sensor then transmits the signal to the controller 25, which generates a controlling signal to activate the water container 24 for sending water to the water-spurting heads 30, thus the water-spurting heads 30 spurt water respectively to cleanse the excretory organs of the patient and flush the excrement down to the water tank 21, and the wastewater is channeled through the base plate of the water tank 21 and discharged through the water outlet.

Figure 3:
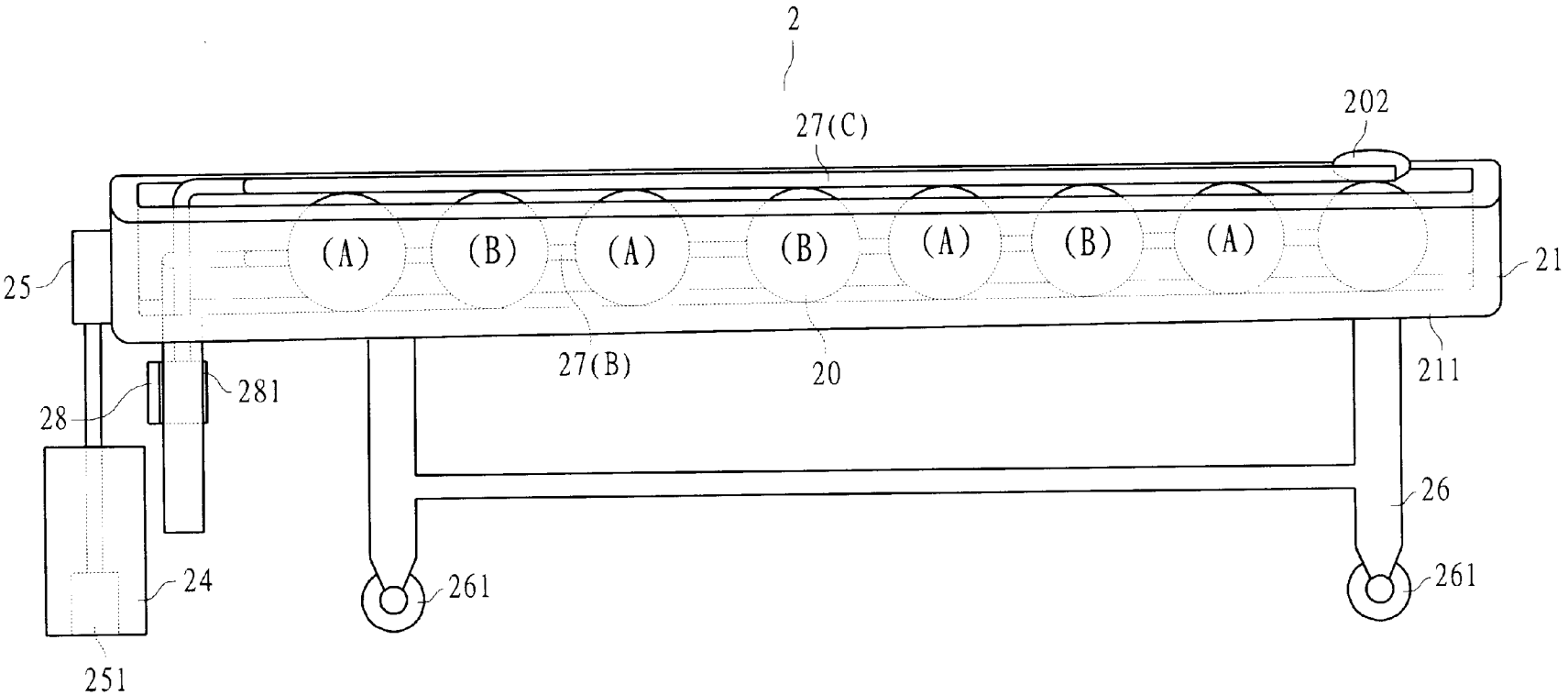
FIG. 3 is a right side view of an air cushion bed of the present invention.

In one of the embodiments of the present invention, as shown in FIG. 1 and FIG. 2, the air cushion bed 2 with flushing device comprises the water tank 21 that is supported by a supporting frame 26 that contains at least four legs, with the end of each leg jointing a wheel 261, enabling the air cushion bed to be moved with ease. In addition, the water tank 21 contains front, rear, left and right walls and a tilted base plate with a water outlet, thus forming a water-holding space. The base plate 211 tilts from one end (e.g. the left end) to the other end (e.g. the right end), and from the upper end to the lower end, thus forming the tilting structure sloping from the upper left end to the lower right end (as shown in FIG. 3). The water outlet 212, capable of filtering the wastewater, is installed at the lowest part of the base plate 211. The air bladder 20, installed on top of the base plate 211 in the water tank 21, contains an air bladder 201 that is kept full of air and used to support the head of the patient, with a removable pillow 202 on its top. The pillow 202 can also become part of the air bladder 20. The air bladder 20 is pierced through and connected by air conduits 27 on both sides, all of which are linked to a pump 28. An electric circuit is formed between the second controller 29 and the pump 28, enabling the user to control the air-pumping condition of the air bladder 20.

Figure 4:
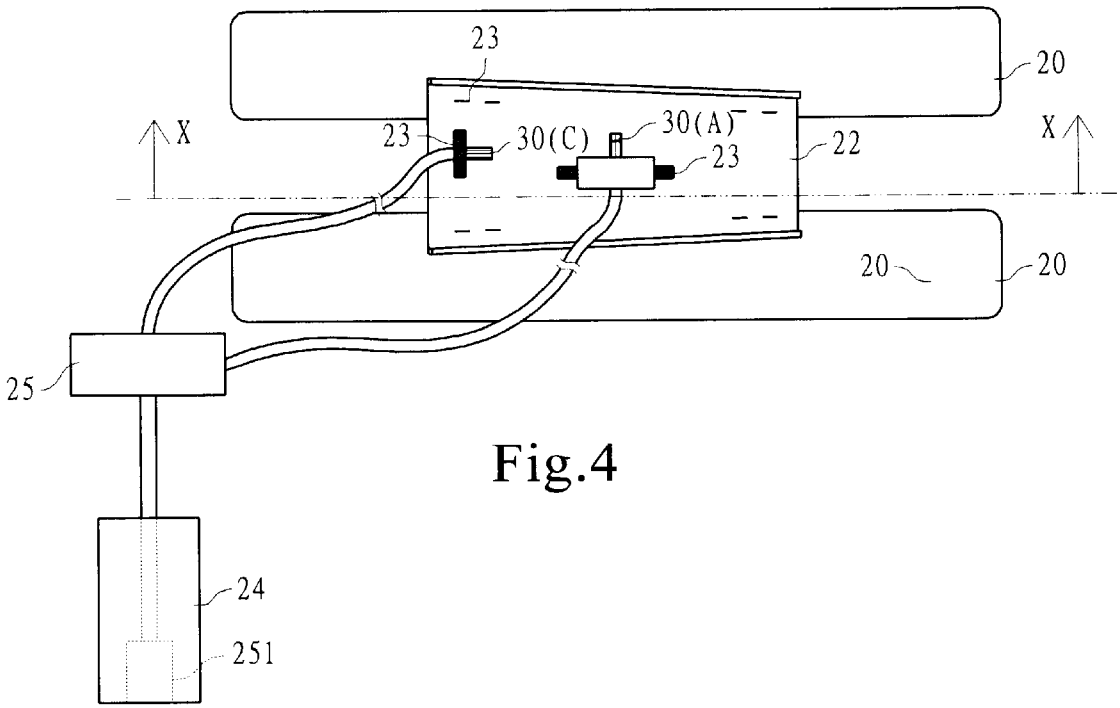
FIG. 4 is a top plan view of a flushing device and a water tank piping in an air cushion bed of the present invention.
Figure 5:
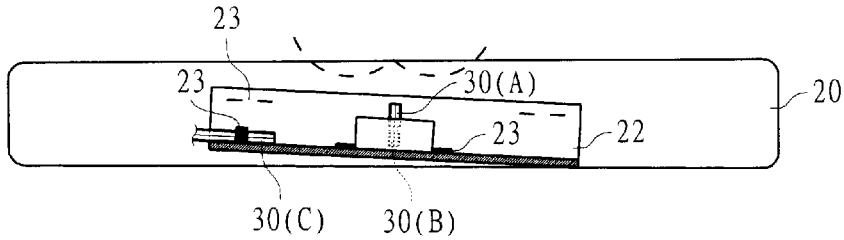
FIG. 5 is a structural cross-sectional view of the X to X section in FIG. 4.

The preferred embodiment of the present invention, shown in FIG. 4 and FIG. 5, includes the sensor that is of an infrared sensor, the first controller 25 that includes a timer (not shown in drawings), and a water pump 251 and water valve installed at the bottom of the water container 24 (not shown in figures). The containing cushion 22 in the air cushion bed with the flushing device of the present invention is tiltedly adhered (e.g., high at left and low at right) in between the two air bladders 20 that are near the buttocks of the patient, wherein the sensor is installed under the anus of the patient, with the water-spurting head 30(A) aimed at the urethra, the water-spurting head 30(B) aimed at the anus, and the water-spurting head 30(C) aimed at the position where excrement is contained. The infrared sensor is able to sense a certain range of area so that when the patient urinates or defecates, the infrared sensor is to sense the interruption of infrared signals and then transmit a signal through cable lines to the timer of the first controller. The timer, in ten seconds after the infrared interruption stops, is to activate the water pump 251 to pump water, and then the water valve is to be opened by a micro-switch, thus water in water container 24 is to be sent to water-spurting heads 30. If the patient urinates, the water-spurting head 30(A) is to spurt water toward urethra of the patient. If the patient defecates, the water-spurting head 30(B) is to spurt water toward the anus of the patient, with the water-spurting head 30(C) flushing excrement contained on the containing cushion 22 down to the water tank. During the water-spurting process of the water-spurting heads 30, the first controller 25 is not to receive the interruption signal of the sensor until one minute after the water-spurting process completes.

In another embodiment of the present invention, the sensor adhered to the containing cushion 22 can include a weight sensor, whereby the weight of the excrement can be detected and the sensing signal transmitted to the first controller 25, so the first controller 25 is to compare the signal to a predetermined value to see if the signal corresponds with the predetermined value; if so, the micro-switch is to open the water valve, sending water from the water container 24 to the water-spurting heads 30.

In the preferred embodiment of the present invention, the air cushion bed with flushing device includes a water container 24, wherein a water-level monitoring device, an electric heater, and a hot-water temperature controller are installed, so that the electric heater heats up water from 30° C. to 40° C. in the water container 24, with the hot-water temperature controller keeping the temperature of the water at that of a predetermined value, thus enabling the air cushion bed to provide both warm and cool water for the patient. The water-level monitoring device, by utilizing the floating ball indicator, is able to warn the user through light or buzzer when the water level is too low, and an automatic electricity-cutout device can be installed with the water-level warning device to cutout the electricity when the water level is too low or any unusual matter occurs.

In the preferred embodiment of the present invention, as shown in FIG. 4, the containing cushion 22 is adhered on top of the air bladder 20 by an adhesive and/or buckling strip 23, and the position of adhesion can be adjusted in accordance with the height of the patient and different lying positions. The water-spurting heads 30 can also be fixed by the adhesive and/or buckling strip 23 or a fixing rack, so that the water-spurting heads 30 can be adjusted to reach the best angle. Furthermore, in the present invention, a piece of water-proof sheet can be placed under bed clothes extending from navel to both thighs of the patient, to prevent the bed clothes from being wet by water spurted by the water-spurting heads 30.

In the preferred embodiment of the present invention, as shown in FIG. 1 and FIG. 2, the air cushion bed 2 with flushing device of the present invention includes the second controller 29 by which controlling signals are to be sent to control the working of the air pump 28, and further activates the air conduits 27(A) and 27(B) to control both the inlet and outlet of the airflow, which, while both channeling the air therein, can inflate the air bladder 20 to reach its full air-containing capacity. Moreover, a pressure sensor is installed at the air outlet of the air pump 28, so that if the air pressure reaches the predetermined pressure value, the operation of the pump 28 shall be stopped, with the air-channeling by the air conduits 27(A) and 27(B ) also being stopped.

The tilting angle of the base plate 211 is so slight that the patient resting on the air bladder 20 shall not sense it; in addition, the air bladder 20 can be designed with linear variations (as shown in FIG. 3), so that the horizontality of the air bladder 20 shall be kept after the completion of the inflation. Water is used to flush the excrement or clean the body of the patient resting on top of the air bladder 20, thereafter the wastewater is flushed through the peripheries of every air bladder 20 down to the water tank 21, then is channeled by the tilted base plate 211 and discharged through the water outlet 212.

In the preferred embodiment of the present invention, as shown in FIG. 1 and FIG. 2, an air conduit 27(C) is installed at both sides of the upper part of the air bladder 20, the width of which shall at least be wider than the shoulder length of the patient so that the patient will not lay on the air conduit 27(C). At the same time, through the operation of the second controller 29, an output signal can be sent to control the operation of another pump 281 (not shown in drawings), which then pumps the air through the air conduit 27(C), so the air is spurted from both sides of the air conduit 27(C) toward the patient resting on the bed, thus keeping the patient's body dry and comfortable. Moreover, an extra bedding cushion (not shown in drawings) can be added on top of the air conduit 27(C) for the patient's comfortable use; also at the outlet of the air pump 281 an instant heating unit can be added to heat up the air instantly, enabling the air conduit 27(C) to pump out cool air during the summer or hot air during the winter.

It is easy for those skilled in the art to employ the micro-computing device for controlling the inflation and deflation of the air bladder 20, and the micro-computing device can also be included in the present invention to achieve the inflation and deflation of respective air bladders, and switch the patient's pressure points, thus the pressure points will not concentrate on a fixed place while the patient rests in bed. The automatic micro-computing control device of the present invention is further described as follows. The air cushion bed 2 with flushing device of the present invention includes the second controller 29, which is an automatic micro-computing control device, comprising a pressure sensor, an automatic pressure controller and an electromagnetic tee valve, wherein the electromagnetic tee valve connects three tubes (one in and two outs), with one end linking the air pump 28 to pump in air, and the other two ends linking the air conduits 27(A) and 27(B), while only either one of the two air conduits 27(A) and 27(B) receiving the air pumped in from the air pump 28, with another one being shut. When the second controller 29 being activated, a signal is outputted to the air pump 28 to pump air into the air conduit 27(A) through the electromagnetic tee valve, thus inflating the air bladders 20(A). In addition, a pressure sensor, installed at the inlet tube near the electromagnetic tee valve, includes a signal wire that connects with the automatic pressure controller, wherein a pre-determined value is installed, so when the pressure level of the air conduit 27(A) and the air bladder 20(A) reaches the predetermined pressure value, the automatic pressure controller will be activated to cause the electromagnetic tee valve to close the passage to the air conduit 27(A) and the air bladders 20(A); then the passage to the air conduit 27(B) is opened, thus the air bladders 20(B) is inflated, while the deflation of the air bladders 20(A) begins. And then when the pressure level of the air conduit 27(B) and the air bladder 20(B) reaches the predetermined pressure value, the automatic pressure controller will again be activated to cause the electromagnetic tee valve to open the passage to the air conduit 27(A), thus inflating the air bladders 20(A) instead. Therefore the process repeats itself until the second controller 29 is turned off. With the process of alternately inflating and deflating the air bladders 20(A) and 20(B), the pressure points of the patient resting in bed are switched, thus the patient's muscles are relaxed, the blood flow enlivened and the damage or necrosis of the patient's back muscles prevented.

In the preferred embodiment of the present invention, the air cushion bed 2 with flushing device includes the water tank 24 that is made of a waterproof material, thus forming a water-holding air container to function as the water tank 24, with the air bladder 20 placed on the base plate 211 at the bottom of the water-holding air container, wherewith an air conduit is connected, with another end connected to the air pump 28 to form a single circuit, thus different from those of the air conduits 27(A), 27(B) and 27(C). When the controller 29 is activated, a controlling signal is outputted to control the operation of the air pump 28 to inflate and deflate the water-holding air container through the air conduit. When the inflation of the water-holding air container is completed, the bottom surface of the concave shall tilt from one end (e.g. the left end) to the other end (e.g. the right end), and from the upper end to the lower end, thus forming a tilted structure sloping from the upper left end to the lower right end, with a water outlet installed at the lowest part of the bottom surface. The tilting angle of the bottom surface is so slight that the patient resting on the air bladder 20 shall not sense it; in addition, the air bladder 20 can be designed with linear variations, so that the horizontality of the air bladder 20 shall be kept after the completion of the inflation. Water is used to flush the excrement or clean the body of the patient resting on top of the air bladder 20, thereafter the wastewater is flushed through the peripheries of every air bladder 20 down to the water-holding air container, then is channeled by the bottom surface 211 and discharged through the water outlet. The embodiment of the present invention provides the user with the foldable function, for the air bladders 20 and the water-holding air container can both be folded for safekeeping after complete deflation. Certainly the embodiment of the present invention, as the previous one, also provides cool or warm air, keeping the user, with the function of heat preserving and coolness-keeping, from dampening, germ-growing condition and skin affection. In addition, the air cushion bed in the embodiment of the present invention can be placed on top of other common sickbeds.

One important issue worth mentioning is that, the wires, circuits and other electric components are made of insulated material, therefore the patient shall never encounter the danger of electric shock during use.

Although the present invention has been described in considerable detail with reference to certain preferred embodiments thereof, those skilled in the art can easily understand that all kinds of alterations and changes can be made within the spirit and scope of the appended claims. For example, the air cushion bed with flushing device of the present invention can further be installed with either fixed or removable water containers on the supporting frame to contain the wastewater or store the cold and hot water for bathing and cleaning. Therefore, the spirit and scope of the appended claims should not be limited to the description of the preferred embodiments contained herein.

What is claimed is:

1. An air cushion bed, comprising:

an air cushion comprising at least two air bladders;

a tank comprising a water-containing space with a base plate and side walls;

a water-draining device connected to said tank;

a flushing device comprising a containing cushion, the containing cushion removably installed between two of the air bladders of said air cushion to form a tilted groove;

a sensor is installed on top of said containing cushion, the sensor is able to detect falling objects thereon and output signals;

a water-spurting device is connected to a water container, an outlet is installed on top of said containing cushion;

a controller receives signals outputted from said sensor and activates said water-spurting device to spurt water; and wherein when a patient resting on the air cushion discharges bodily waste, said sensor detects the discharge and sends signals to said controller, said water-spurting device is activated to spurt water to both cleanse a patient's body and flush discharged bodily waste down to said tank such that bodily waste and water is drained into said water-draining device.

2. The air cushion bed as in claim 1 wherein said sensor comprises an infrared sensor that is adapted to aim at an excretory orifice of a patient and is able to detect excrement dropping on said containing cushion after which signals are sent to said controller.

3. The air cushion bed as in claim 1, wherein said sensor is adhered on top of said containing cushion and is comprised of a weight sensor, which upon detecting weight of solid bodily waste, transmits weight signals to said controller which then activates said water-spurting device to spurt water adapted to cleanse a patient's body.

4. The air cushion bed as claimed in claim 1 wherein said containing cushion is adhered to said air bladders by an adhesive and/or buckling strip.

5. The air cushion bed as claimed in claim 1, wherein said water-spurting device is installed on top of said containing cushion and includes three water-spurting heads, with the first one of the water-spurting heads adapted to be aimed at a patient's urethra, the second one of the water-spurting heads adapted to be aimed at a patient's anus, and the third one of the water-spurting heads adapted to be aimed at the groove formed by said containing cushion, so that after the first and second ones of the water-spurting heads have cleansed a patient's urethra and anus, the third one of the water-spurting heads can flush bodily discharge deposited on said containing cushion down to said tank.

6. The air cushion bed as claimed in claim 1, wherein a portion of a water-proof sheet can be adapted to be placed under bed clothes extending from a patient's navel to a patient's thighs to prevent said bed clothes from becoming wet by water spurted by said water-spurting heads.

7. The air cushion bed as in claim 1, wherein said base plate of said tank is shaped tiltedly from the horizontal to expedite the discharge of water by said water-draining device.

8. The air cushion bed as in claim 7, wherein a water outlet is installed at a lower bottom of said tank in said water-draining device.

9. The air cushion bed as in claim 1, wherein said tank comprises air-containing air bladders to form a water-containing space.

10. The air cushion bed as in claim 7, wherein said tank comprises air-containing air bladders to form a water-containing space.

11. The air cushion bed as in claim 8, wherein said tank comprises air-containing air bladders to form a water-containing space.

12. The air cushion bed as in claim 1, further comprising a second controller, and said second controller controls airflow to said air bladder from a pump through air conduits, thus controlling the inflation and deflation of said air bladder.

13. The air cushion bed as in claim 12, further comprising an air conduit with air holes, the air conduit is connected to said air bladder and said pump is controlled by said second controller, so that air is spurted out to said air bladder from said pump through said air conduit.

14. The air cushion bed as in claim 13, wherein said second controller controls discharge of either cool or warm air.

15. The air cushion bed as in claim 13, wherein the combination of said pump and said second controller includes a micro-computing controller, said pump, an electromagnetic valve, a pressure sensor, and an automatic pressure controller; said pump is controlled by said micro-computing controller, and said electromagnetic valve is installed between said pump and said air conduit; said pressure sensor detects the pressure of the air bladder and enables the inflation and deflation of said air bladder.

16. The air cushion bed as in claim 13, wherein said combination of said pump and said second controller includes a micro-computing controller, said pump, an electromagnetic valve, and a heating unit; said pump is controlled by said micro-computing controller, and said electromagnetic valve is installed between said pump and said air conduit; said heating unit is installed at the air outlet of said pump, thus heating up the air spurted through said air hole of said air conduit.

17. The air cushion bed as in claim 1, wherein said tank is adapted to be placed on standard sickbeds.

18. The air cushion bed as in claim 1, wherein said controller includes a micro-computing controller, a water pump and a water valve; said micro-computing controller receives output signals from said sensor, thus activating said water pump to send water from said water container to said water-spurting device, and then said water valve is to be controlled so that said water-spurting device spurts water to cleanse the body of said patient.

19. The air cushion bed as in claim 1, further comprising a pillow attached to said air bladder.

20. The air cushion bed as in claim 1, wherein said air bladder comprises a waterproof material.

* * * * *